US009074489B2

(12) United States Patent
Eleftheriou et al.

(10) Patent No.: US 9,074,489 B2
(45) Date of Patent: Jul. 7, 2015

(54) CONNECTOR ASSEMBLY FOR VARIABLE INLET GUIDE VANES AND METHOD

(75) Inventors: Andreas Eleftheriou, Woodbridge (CA); David Harold Menheere, Georgetown (CA); Andrew Marshall, Grand Valley (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 626 days.

(21) Appl. No.: 13/429,839

(22) Filed: Mar. 26, 2012

(65) Prior Publication Data

US 2013/0251518 A1 Sep. 26, 2013

(51) Int. Cl.

| | |
|---|---|
| ***F04D 29/54*** | (2006.01) |
| ***F01D 17/16*** | (2006.01) |
| ***F04D 9/04*** | (2006.01) |
| ***F04D 29/56*** | (2006.01) |

(52) U.S. Cl.

CPC ..... *F01D 17/162* (2013.01); *Y10T 29/49245* (2015.01); *F04D 9/042* (2013.01); *F04D 29/563* (2013.01)

(58) Field of Classification Search

CPC ..... F01D 9/42; F01D 17/162; F04D 15/0038; F04D 27/002

USPC ..... 415/160; 29/889.22

See application file for complete search history.

(56) References Cited

U.S. PATENT DOCUMENTS

| | | | | | |
|---|---|---|---|---|---|
| 1,980,123 | A | * | 11/1934 | Weber | 384/474 |
| 3,990,810 | A | * | 11/1976 | Amos et al. | 415/161 |
| 3,999,883 | A | * | 12/1976 | Nordenson | 415/113 |
| 4,307,994 | A | * | 12/1981 | Brewer | 415/160 |
| 5,395,211 | A | | 3/1995 | Johnson | |
| 5,547,342 | A | | 8/1996 | Furseth | |
| 6,413,043 | B1 | * | 7/2002 | Bouyer | 415/159 |
| 6,676,378 | B2 | | 1/2004 | Corbin | |
| 6,890,151 | B2 | | 5/2005 | Bertrand | |
| 7,238,003 | B2 | | 7/2007 | Synnott | |
| 7,637,718 | B2 | | 12/2009 | Barnett | |

* cited by examiner

*Primary Examiner* — Ninh H Nguyen

(74) *Attorney, Agent, or Firm* — Norton Rose Fulbright Canada LLP

(57) ABSTRACT

A connector assembly for variable inlet guide vanes in a compressor case of a gas turbine engine comprises an annular case insert having a plurality of circumferentially distributed open-ended receptacles. The annular case insert is sized so as to be received inside a compressor case, with the plurality of circumferentially distributed open-ended receptacles being in register with holes in the compressor case. Bushings have an outer diameter sized to be received in a respective one of the receptacles of the annular case insert, and an inner diameter adapted to receive a connector portion of a vane. Sets of the bushing and the connector portion of a vane in one of the receptacles forming a rotational joint. A method for installing vanes in a compressor case is also provided.

18 Claims, 5 Drawing Sheets

CONNECTOR ASSEMBLY FOR VARIABLE INLET GUIDE VANES AND METHOD

TECHNICAL FIELD

The application relates generally to variable inlet guide vanes in gas turbine engines and, more particularly, to a connector assembly for connecting a vane to the compressor case in a variable inlet guide configuration.

BACKGROUND OF THE ART

Variable inlet guide vanes are commonly used in gas turbine engines to control a flow of air within a case, such as a compressor case. The angle of the vanes is adjustable for this purpose. Assembly methods for variable inlet guide vanes traditionally involves positioning each vane into a bushing which is pressed into the compressor case. This method of assembly generally requires a substantial amount of time and limits design options because of assembly restrictions resulting from mating parts within a case. The assembly using traditional methods limits the spacing between vanes because of the difficulty in installing the last vane in a stage. The last vane must be able to rotate into position without interference from adjacent vanes. Accordingly, traditional assembly methods have required for instance the addition of the flange to the outer case for this very purpose, resulting in an increased weight, a larger part count and longer assembly time.

SUMMARY

In one aspect, there is provided a connector assembly for variable inlet guide vanes in a compressor case of a gas turbine engine comprising: an annular case insert having a plurality of circumferentially distributed open-ended receptacles, the annular case insert being sized so as to be received inside a compressor case, with the plurality of circumferentially distributed open-ended receptacles being in register with holes in the compressor case; and bushings having an outer diameter sized to be received in a respective one of the receptacles of the annular case insert, and an inner diameter adapted to receive a connector portion of a vane, sets of said bushing and said connector portion of a vane in one of said receptacles forming a rotational joint.

In a second aspect, there is provided a gas turbine engine comprising: a compressor case with an inner cavity and a plurality of circumferentially distributed holes in the compressor case; a plurality of vanes having a connector portion; a connector assembly comprising: an annular case insert having a plurality of circumferentially distributed open-ended receptacles, the annular case insert being sized so as to be received in the inner cavity of the compressor case, with the plurality of circumferentially distributed open-ended receptacles being in register with the holes in the compressor case; and bushings having an outer diameter sized to be received in a respective one of the receptacles of the annular case insert, and an inner diameter receiving the connector portion of a corresponding one of the vanes, with sets of said bushing and said connector portion of a vane in one of said receptacles forming a rotational joint.

In a third aspect, there is provided a method for installing vanes in a compressor case comprising: inserting bushings in receptacles of an annular case insert; inserting a connector portion of vanes in at least some of the bushings to form a rotational joint between said vanes and the annular case insert; positioning the annular case insert with the bushings and the vanes inside a compressor case; aligning the receptacles with holes in the compressor case; and connecting an actuator interface to at least some of said connector portion of vanes through said holes from an exterior of the compressor case.

Further details of these and other aspects of the present invention will be apparent from the detailed description and figures included below.

DESCRIPTION OF THE DRAWINGS

Reference is now made to the accompanying figures, in which.

DETAILED DESCRIPTION OF THE PREFERRED EMBODIMENTS

Figure 1:
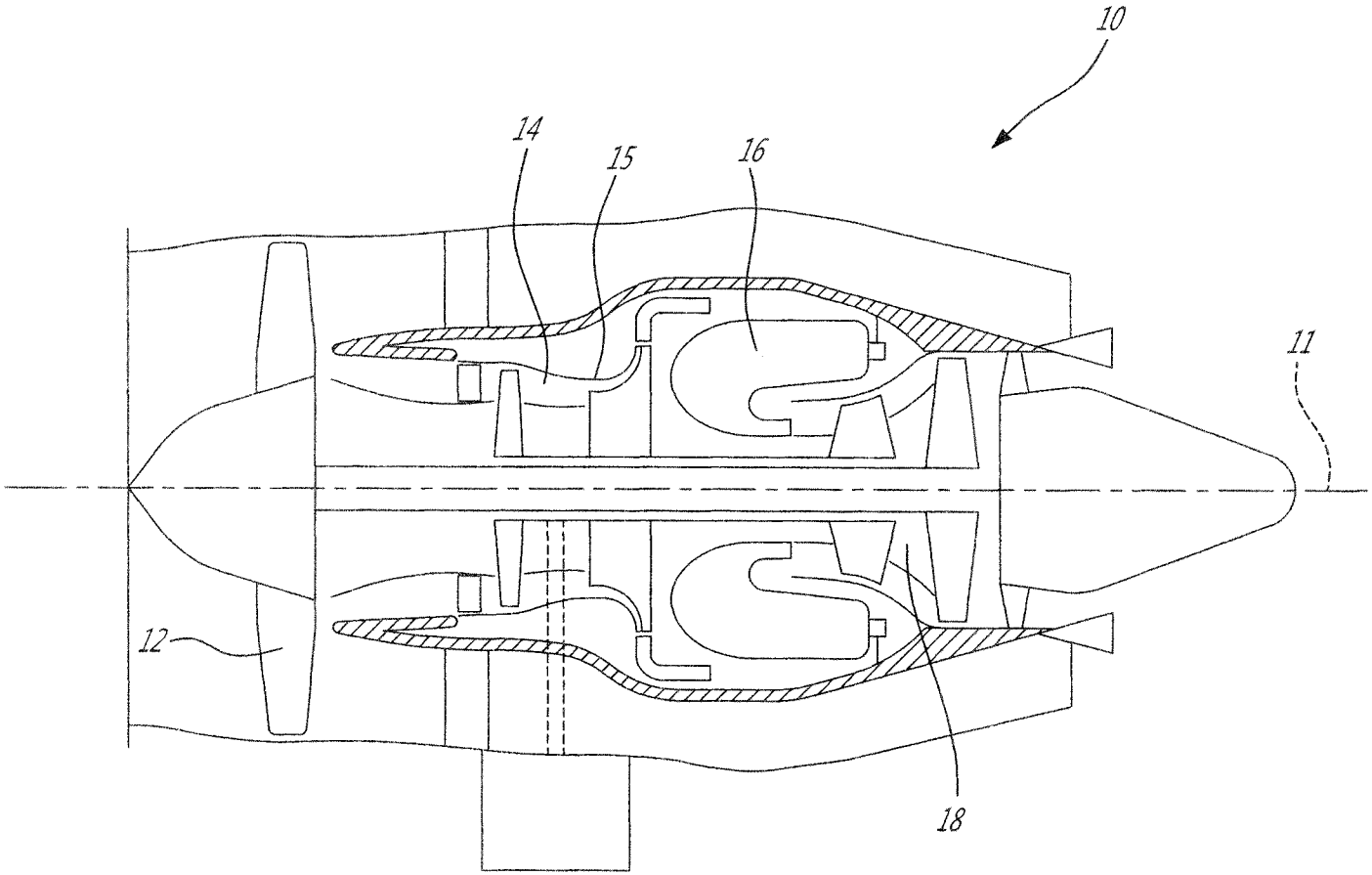
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air within a compressor case 15, a combustor 16 in which the compressed air is mixed with fuel and ignited for generating an annular stream of hot combustion gases, and a turbine section 18 for extracting energy from the combustion gases.

Figure 2:
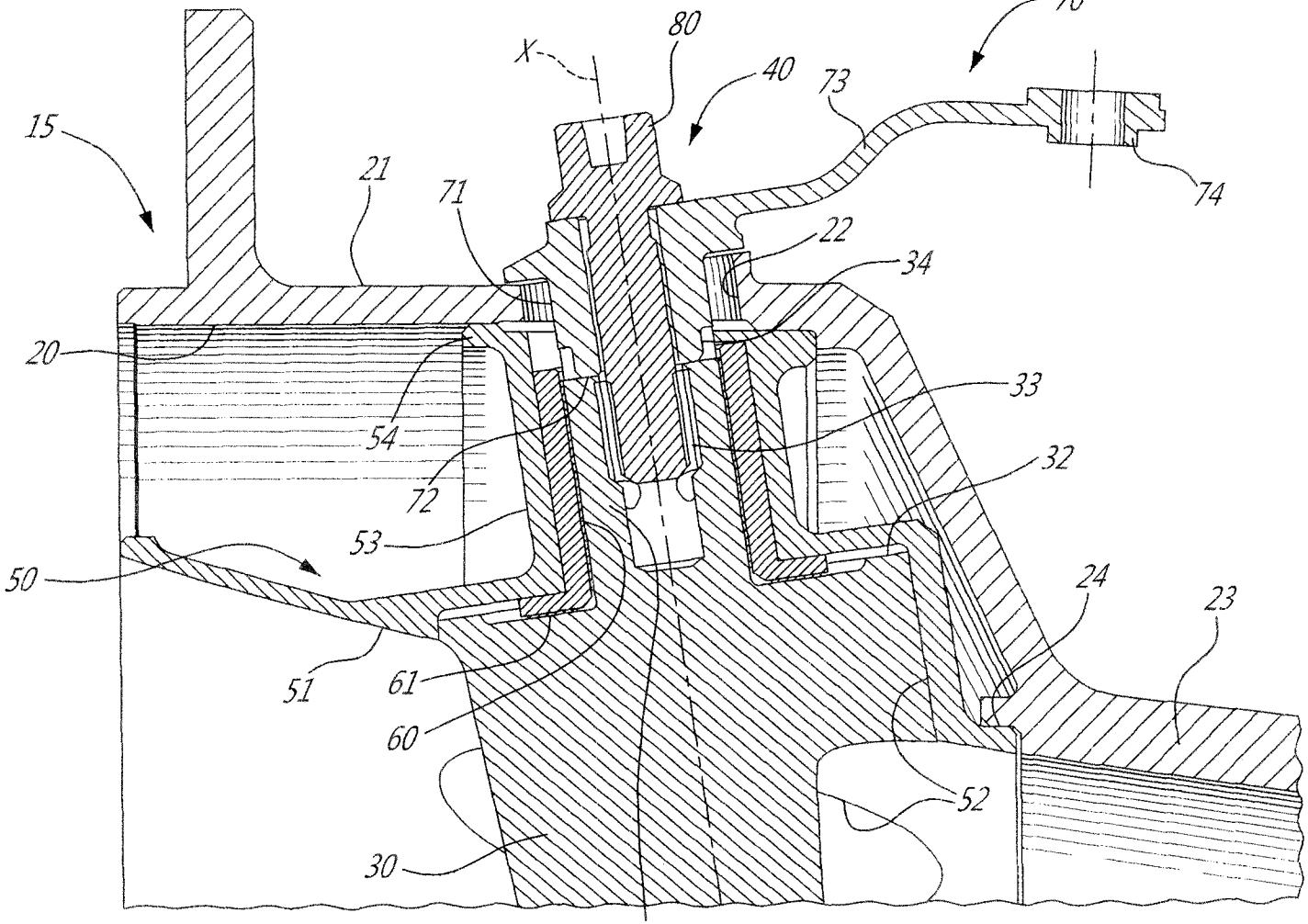
FIG. 2 is an enlarged sectional view of a vane connected to a compressor case by a connector assembly in accordance with the present disclosure.

Referring to FIG. 2, an enlarged view of a portion of the compressor case 15 is illustrated in relation to a variable inlet guide vane (only one vane shown for simplicity purposes). The compressor case 15 comprises an annular body for instance made of sheet metal and forged rings or forged parts. The compressor case 15 therefore has an inner surface 20 and an outer surface 21, with the inner surface 20 oriented towards a centerline of the gas turbine engine, while the outer surface 21 is oriented away. Clearance holes 22 are circumferentially distributed in the compressor case 15. The clearance holes 22 may be equidistantly spaced apart from one another. The compressor case 15 may also comprise a downstream throat portion 23. An annular shoulder 24 may be defined at an upstream end of the throat portion 23.

Referring to FIG. 2, a vane is generally shown at 30. The vane 30 is used in a variable inlet guide configuration, and therefore may be rotated about its longitudinal axis illustrated at X. Only a portion of the vane 30 is visible in FIG. 2, with a radially inward end being pivotally supported to allow the rotation of the vane 30. The vane 30 has a connector portion 31 projecting radially outwardly from a radial edge 32. The connector portion 31 has a tapped bore 33 to receive an appropriate fastener. A mating connector 34 is also defined in the connector portion 31 and may be in a quasi-counterbore configuration relative to the tapped bore 33.

Referring concurrently to FIGS. 2-5, a connector assembly is generally shown at 40 and is used to connect the vane 30 to the compressor case 15 at one of the clearance holes 22 in such a way that the vane 30 may rotate about its longitudinal axis X. The connector assembly 40 and vanes 30 may be in the high pressure of low pressure section of the compressor case. The connector assembly 40 has a case insert 50. The case insert 50 has an annular wall 51 that is shaped to be concentrically inserted in the compressor case 15. As shown in FIG. 2, a radially inward surface of the annular wall 51 may be slightly flared along an axial direction of the gas turbine engine. Moreover, a downstream tip of the annular wall 51 may be received in the annular shoulder 24 of the compressor case 15 to find a generally continuous surface at the junction between the compressor case 15 and the annular wall 51. Open-ended receptacles 52 are circumferentially distributed in the annular wall 51 in such a way that they are in register with a respective clearance hole 22. The receptacles 52 may comprise a generally circular section to accommodate a radially outward end of a respective vane 30. Each receptacle 52 has a radially outwardly projecting neck 53. The necks 53 are hollow and are sized to a diameter generally equivalent to that of the clearance holes 22. Therefore, a passage is defined from an inside to outside of the compressor case 15 by the sequence of the receptacle 52, the neck 53 and the clearance hole 22. A flange 54 may be provided at a free end of each of the necks 53, for abutment against the inner surface 20 of the compressor case 15.

A bushing 60 is provided for each vane 30. The bushing 60 is sized to be the interface between the connector portion 31 of the vane 30 and the inner surface of the neck 53. In an embodiment, the bushing 60 is force-fitted in the neck 53, or fixed to the neck 53 in any appropriate manner. According to an embodiment, the bushing 60 is made of a material with a relatively low coefficient of friction. Hence, the combination of the connector portion 31 and the bushing 60 defines a rotational joint, while the bushing 60 remains fixed to the case insert 50. A flange 61 may be located at a radially inward end of the bushing 60 to abut against the radial edge 32 of the vane 30. The rotational joint could alternatively be defined between the bushing 60 and the receptacle 52.

Referring to FIGS. 2 to 5, an actuator interface 70 is matingly engaged to the connector portion 31 of the vane 30, so as to rotate therewith. The actuator interface 70 interfaces the vane 30 to an actuator that will adjust an angle of the vane 30 relative to the compressor case 15. Therefore, the actuator interface 70 has a collar 71 at a first end. A corresponding mating connector 72 of the collar 71 is in mating engagement with the mating connector 34 of the connector portion 31 of the vane 30, enabling the transmission of an actuation from the actuator interface 70 to the vane 30. Any appropriate mating connector configuration is considered for the interconnection between the vane 30 and the actuator interface 70. The actuator interface 70 comprises an arm 73 with a connector 74 at a free end thereof. The connector 74 is shown as being an eyelet or tang that may be used to define a rotational joint, among numerous other possibilities.

Referring to FIG. 2, a fastener 80 such as a bolt secures the connector assembly 40 to the vane 30. The fastener 80 is inserted through the collar 71, to reach the tapped bore 33 in which it will be threadingly engaged.

Now that the various components of the vane 30 and the connector assembly 40 have been defined, and installation of the vane 30 to the compressor case 15 using the connector assembly 40 now be described.

Figure 3:
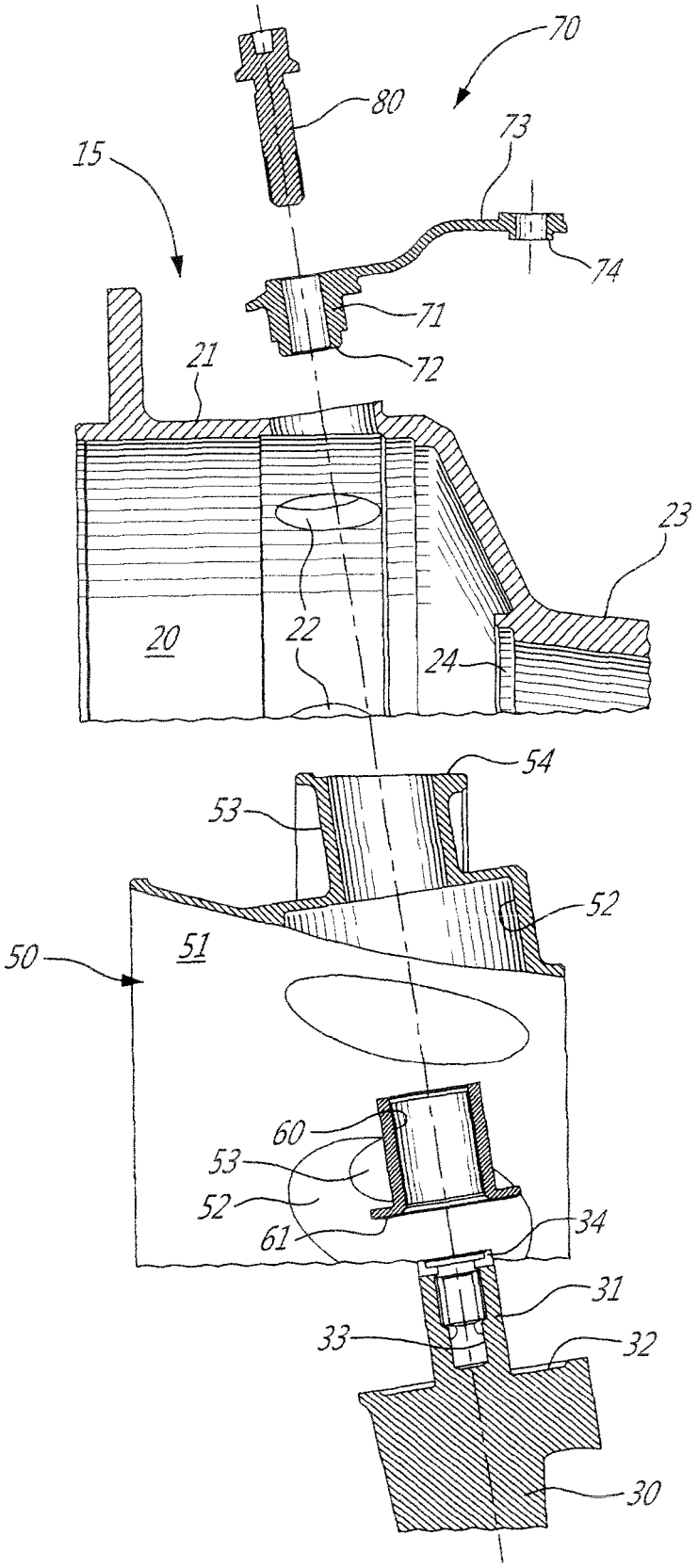
FIG. 3 is an exploded view of the assembly of FIG. 2.

Referring to FIG. 3, the bushings 60 are installed into the cavities of the necks 53 of the case insert 50. In an embodiment, some form of interference or force fit is provided between the bushings 60 and the case insert 50, for the bushings 60 to remain engaged to the case insert 50.

Still referring to FIG. 3, the connector portions 31 of the vanes 30 are inserted in the bushings 60. Therefore, a rotational joint is formed between each of the vanes 30 and the case insert 50. In an embodiment, this step is repeated for all the vanes 30 to be used with the case insert 50. According to an embodiment, the vanes 30 and bushings 30 may be jointly installed in the case insert 50.

Figure 4:
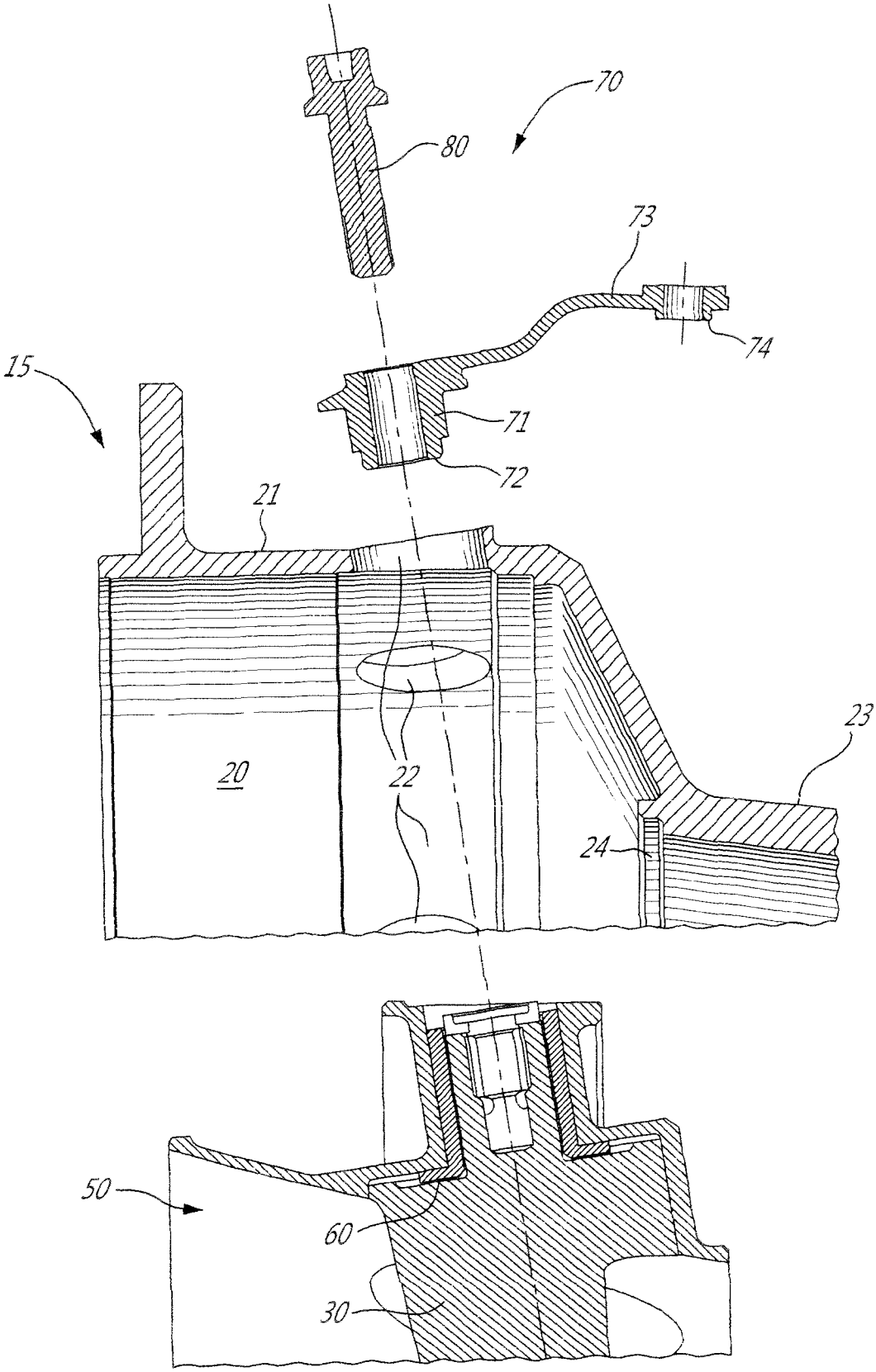
FIG. 4 is an assembly view of a case insert with vane and connector assembly being inserted in the compressor case in accordance with the present disclosure.

Referring to FIG. 4, the case insert 50 may then be inserted in the compressor case 15, with the case insert 50 supporting concurrently the vanes 30 and the bushings 60. The case insert 50 is inserted via an open end of the case 15 and moved axially to the position illustrated in FIG. 5. As mentioned previously, a tip of the annular wall 51 of the case insert 50 may be received in a shoulder 24 of the compressor case 15. The annular wall 51 may be in a concentric relation with the compressor case 15.

Figure 5:
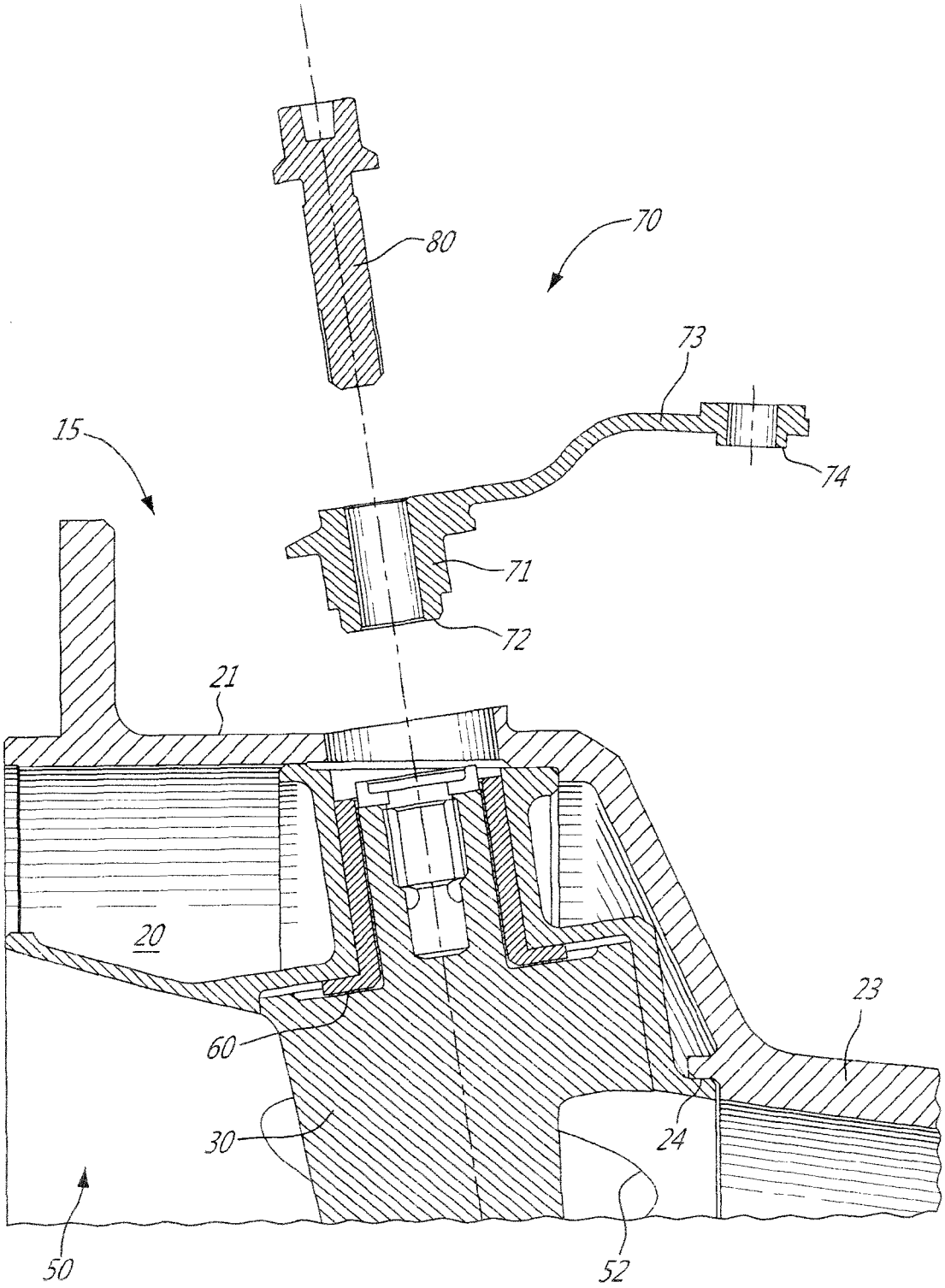
FIG. 5 is a further assembly view of an actuator interface and fastener being secured to a respective vane in accordance with the present disclosure.

Referring to FIG. 5, the actuator interface 70 is secured to a respective vane 30 by the fastener 80. This may be performed by the appropriate tool such as a screwdriver, a ratchet etc. The actuator interface 70 may then be connected to the actuator (not shown), whereby an actuation performed by the actuator will cause the rotation of the vane 30 about its longitudinal axis X.

The above description is meant to be exemplary only, and one skilled in the art will recognize that changes may be made to the embodiments described without departing from the scope of the invention disclosed. For example, [describe any modifications, such as different materials, engine types, whatever else is apparent or comes to mind]. . . Still other modifications which fall within the scope of the present invention will be apparent to those skilled in the art, in light of a review of this disclosure, and such modifications are intended to fall within the appended claims.

What is claimed is:

1. A connector assembly for variable inlet guide vanes in a compressor case of a gas turbine engine comprising:

an annular case insert having a plurality of circumferentially distributed open-ended receptacles, the annular case insert being sized so as to be received inside a compressor case, with the plurality of circumferentially distributed open-ended receptacles being in register with holes in the compressor case; and bushings having an outer diameter sized to be received in a respective one of the receptacles of the annular case insert, and an inner diameter adapted to receive a connector portion of a vane, sets of said bushing and said connector portion of a vane in one of said receptacles forming a rotational joint, each of said bushings having a first end being radially outward and a second end radially inward when received in the annular case insert, the first end being radially inward of an open end of the respective one of the receptacles of the annular case insert when therein.

2. The connector assembly according to claim 1, wherein each said open-ended receptacle comprises a hollow neck projecting radially from a remainder of the receptacle, said necks accommodating one of the bushings.

3. The connector assembly according to claim 1, wherein an inner surface of the annular case insert forms a continuous surface with an adjacent throat portion of the compressor case.

4. The connector assembly according to claim 1, wherein each said bushing has a flange adapted to contact a radial edge of a respective vane.

5. The connector assembly according to claim 1, wherein each said bushing is force fitted in a respective one of the receptacles.

6. The connector assembly according to claim 1, wherein the rotational joint is formed between each said bushing and a respective one of the connector portions of the vanes.

7. A gas turbine engine comprising:

a compressor case with an inner cavity and a plurality of circumferentially distributed holes in the compressor case;

a plurality of vanes having a connector portion;

a connector assembly comprising:

an annular case insert having a plurality of circumferentially distributed open-ended receptacles, the annular case insert being sized so as to be received in the inner cavity of the compressor case, with the plurality of circumferentially distributed open-ended receptacles being in register with the holes in the compressor case; and bushings having an outer diameter sized to be received in a respective one of the receptacles of the annular case insert, and an inner diameter receiving the connector portion of a corresponding one of the vanes, with sets of said bushing and said connector portion of a vane in one of said receptacles forming a rotational joint, each of said bushings and corresponding one of the vanes having a first end being radially outward and a second end radially inward when received in the annular case insert, the first ends being radially inward of an open end of the respective one of the receptacles of the annular case insert when therein.

8. The gas turbine engine according to claim 7, further comprising an actuator interface for each said vane, the actuator interface being substantially outside of the compressor case and being operatively connected to the connector portion of a corresponding one of the vanes via one of the holes in the compressor case.

9. The gas turbine engine according to claim 8, further comprising fasteners releasably securing each said actuator interface to the corresponding one of the vanes, a fastening end of each said fastener being substantially outside of the compressor case.

10. The gas turbine engine according to claim 7, wherein each said open-ended receptacle comprises a hollow neck projecting radially from a remainder of the receptacle, each said neck accommodating one of the bushings.

11. The gas turbine engine according to claim 7, wherein an inner surface of the annular case insert forms a continuous surface with an adjacent throat portion of the compressor case.

12. The gas turbine engine according to claim 7, wherein each said bushing has a flange adapted to contact a radial edge of a respective one of the vanes.

13. The gas turbine engine according to claim 7, wherein each said bushing is force fitted in a respective one of the receptacles.

14. The gas turbine engine according to claim 7, wherein the rotational joint is formed between each said bushing and a respective one of the connector portions of the vanes.

15. A method for installing vanes in a compressor case comprising:

inserting bushings in receptacles of an annular case insert;

inserting a connector portion of vanes in at least some of the bushings to form a rotational joint between said vanes and the annular case insert;

positioning the annular case insert with the bushings and the vanes formed into the rotational joints inside a compressor case;

aligning the receptacles with holes in the compressor case; and connecting an actuator interface to at least some of said connector portion of vanes through said holes from an exterior of the compressor case.

16. The method according to claim 15, wherein inserting bushings in receptacles comprises force fitting the bushings in the receptacles of the annular case insert.

17. The method according to claim 15, wherein positioning the annular case insert comprises moving the annular case insert along an axial direction of the compressor case.

18. The method according to claim 15, wherein connecting the actuator interface to each said connector portion comprises using a fastener manipulated from an exterior of the compressor case.

* * * * *